US006030243A

United States Patent [19]

Harting et al.

[11] Patent Number: 6,030,243

[45] Date of Patent: Feb. 29, 2000

[54] PLUG CONNECTOR FOR CARD-EDGE MOUNTING

[75] Inventors: Dietmar Harting, Espelkamp; Günter Pape, Enger; Dieter Lüttermann, Lübbecke, all of Germany

[73] Assignee: Harting KGaA, Germany

[21] Appl. No.: 09/097,071

[22] Filed: Jun. 12, 1998

[30] Foreign Application Priority Data

Jun. 19, 1997 [DE] Germany ..... 197 25 966

[51] Int. Cl.[7] ..... H01R 13/15

[52] U.S. Cl. ..... 439/260; 439/267

[58] Field of Search ..... 439/260, 267, 439/325, 328, 626, 629, 188, 593, 69, 65, 79, 80, 495, 261, 262, 263, 13, 372

[56] References Cited

U.S. PATENT DOCUMENTS 4,560,221 12/1985 Olsson ..... 439/260

FOREIGN PATENT DOCUMENTS 0377984 7/1990 European Pat. Off. ..... H01R 23/68
38 22 980 C2 6/1990 Germany .
195 11 508 A1 10/1996 Germany .
195 30 994 C1 10/1996 Germany .

*Primary Examiner*—Paula Bradley
*Assistant Examiner*—Alexander Gilman
*Attorney, Agent, or Firm*—Dorn, McEachran, Jambor & Keating

[57] ABSTRACT

For a plug connector for card-edge mounting, in particular a plug connector with 2 or more rows, it is proposed that the printed circuit board connection side of the plug connector should have at least one press-on body which is connected to the insulating body of the plug connector so as to be capable of rotating or hinging and in which the soldering connections of the contacts of the plug connector are held.

9 Claims, 3 Drawing Sheets

PLUG CONNECTOR FOR CARD-EDGE MOUNTING

The invention relates to a plug connector for card-edge mounting, in particular a plug connector with 2 or more rows for SMD connection to a printed circuit board, wherein the printed circuit board connection side of the plug connector has at least one press-on body which is connected to the insulating body of the plug connector so as to be capable of rotating or hinging and in which the soldering connections of the contacts of the plug connector are held.

It is known practice to mount surface-mountable components on both sides of a printed circuit board. For reasons of space, the surface-mountable components (surface-mounted devices, SMD) are kept very low in height and small in order to be able to accommodate as many components as possible on one printed circuit board and in order to keep the assembly low in height.

The so-called "surface-soldering technique" (surface-mounted technology—SMT) was developed as a substitute for the conventional soldering-in technique, in order to simplify the automatic fitting of printed circuit boards with electronic components. In this technique, deposits of solder are applied to surface regions (soldering pads) of the printed circuit boards by means of solder pastes, in which the connection contacts of the components are vertically immersed. In the process, special automatic fitting machines fit and position the surface-mountable components (surface-mounted devices, SMD's) in the correct location on a printed circuit board. The soldering of the complete printed circuit board then takes place in a soldering installation. In the case of a board fitted with components on both sides, the said board is turned over and the second side is provided with solder paste, fitted with components and soldered.

In order to connect the printed circuit boards to the rear wall of a printed circuit board of a slide-in frame or rack, the predominant practice is to mount plug connectors by the pressing-in technique, or else use multi-row SMD plug connectors which are stacked vertically, on the printed circuit board. As a result of this, the width of installation of a slide-in SMD assembly is subsequently determined only by the height of the plug connectors. The extra space gained by means of the surface-mounted components is thus lost again because of the relatively "large" vertical height plug connectors.

An electrical connector for card-edge mounting for connection to the surface of a printed circuit board is known from DE 195 11 508 A1, in which the printed circuit board connection side has a press-on body which is connected to the insulating body of the connector so as to be capable of hinging and in which the contact connections of the connector are held.

In addition, a plug connector for card-edge mounting is known from DE 195 30 994 C1, in which contact springs rest on contact faces on the printed circuit board when the latter is in the inserted state.

Furthermore, a connector for printed circuit boards which has a press-on body which presses resilient contact elements onto a flat electrical conductor, is known from DE 38 22 980 C2.

The underlying object of the invention is to construct a plug connector of the initially mentioned type in such a way that the said connector can be attached to the printed circuit board by surface mounting, is simple to mount and, at the same time, has a low structural vertical height.

This object is achieved through the fact that the plug connector is opened in a "jaws-like" manner for the mounting process, while a releasing mechanism opens the press-on body, against the spring force of the contact springs, for the insertion of the printed circuit board, that at least one side of the soldering connections of the contacts is pressed against the printed circuit board by means of the press-on body on the rotatably mounted side, and that the pressing-on force of the press-on body is applied by the spring force of the contact springs.

The advantages obtained with the invention consist, in particular, in the fact that the plug connector according to the invention has a high contact density and the printed circuit board provided therewith has only a low structural height, while optimum space-utilization of the current card height (320 contacts/100 mm) is achieved through the simultaneous use of both sides of the plug-in card. A further advantage lies in the symmetrical arrangement of the plug connector in relation to the daughter card (straddle mount).

The plug connector also has the same installation conditions as existing 2.0 mm and 2.5 mm "hard metric" plug connector systems, and integratability into existing SMD mounting installations, and also automatic fixing of the plug connector on the printed circuit board until soldering takes place, are likewise provided.

The connection of the printed circuit board (daughter card) to a rear wall printed circuit board (backplane) via the plug connector by the surface mounting technique meets the requirement for components which are ever lower in height. The plug connector can be constructed with 2 or more rows.

An exemplified embodiment of the invention is represented in the drawings and will be described in greater detail below. In the drawings.

Figure 1:
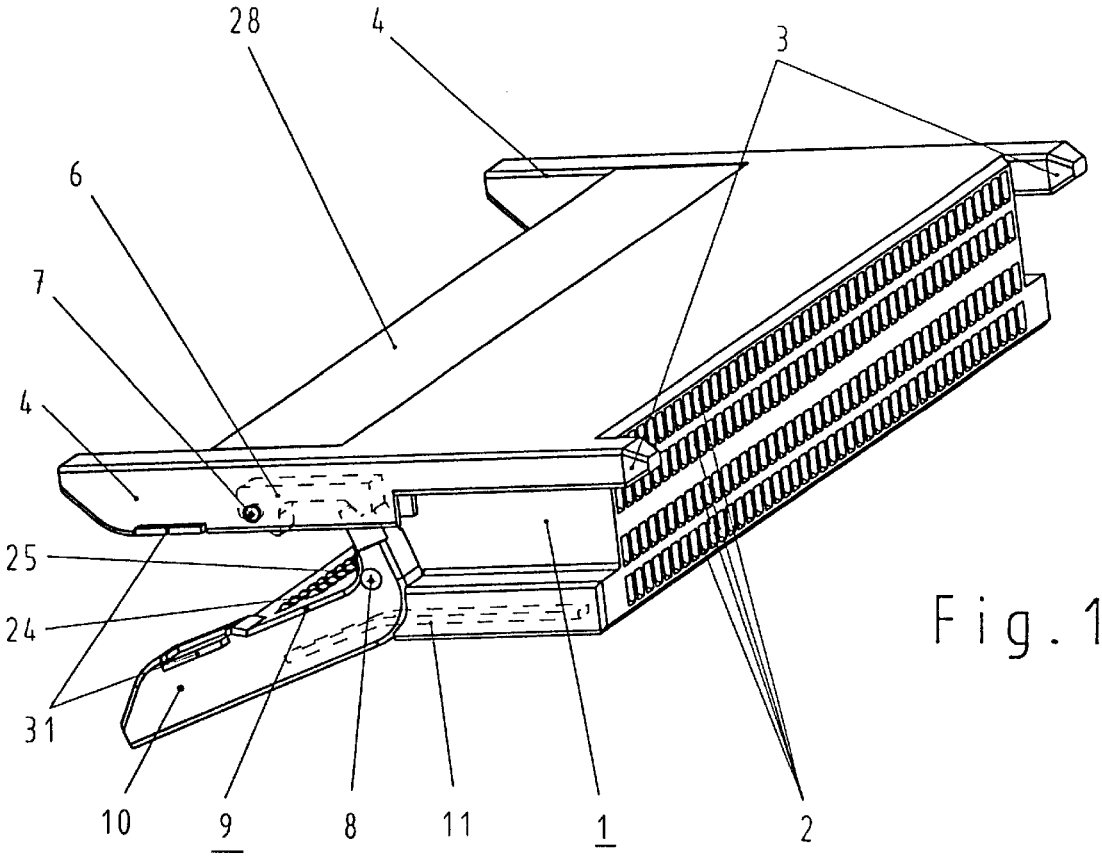
FIG. 1 shows a view of a plug connector.
Figure 2:
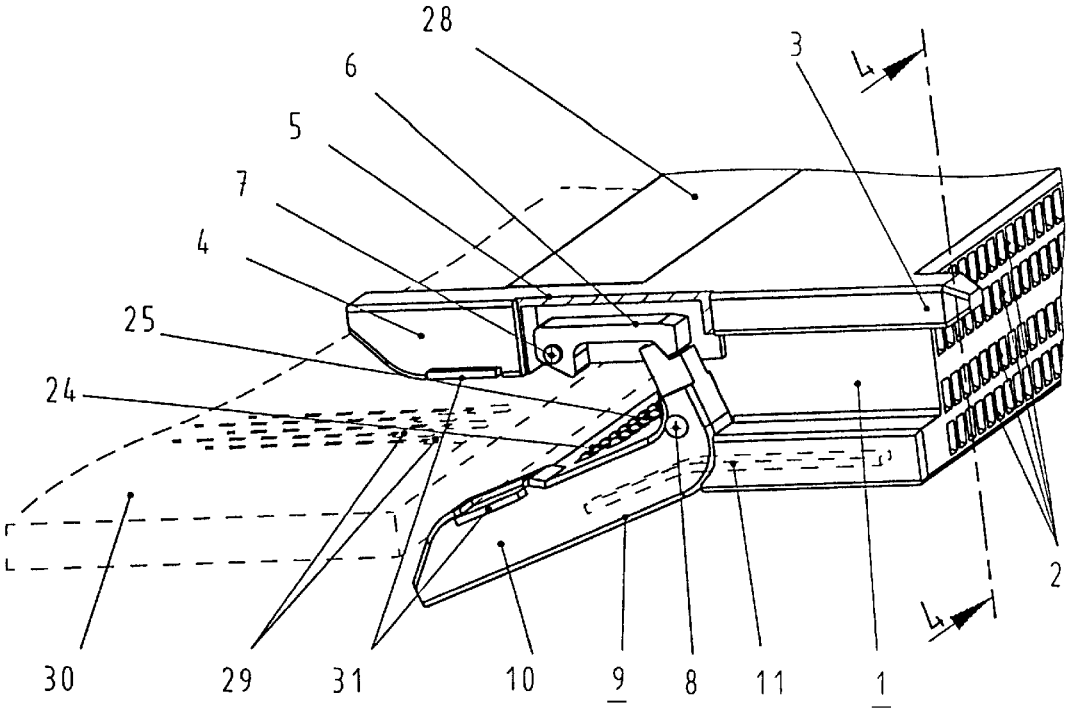
FIG. 2 shows the view of the plug connector with the press-on body hinged open and latched.
Figure 3:
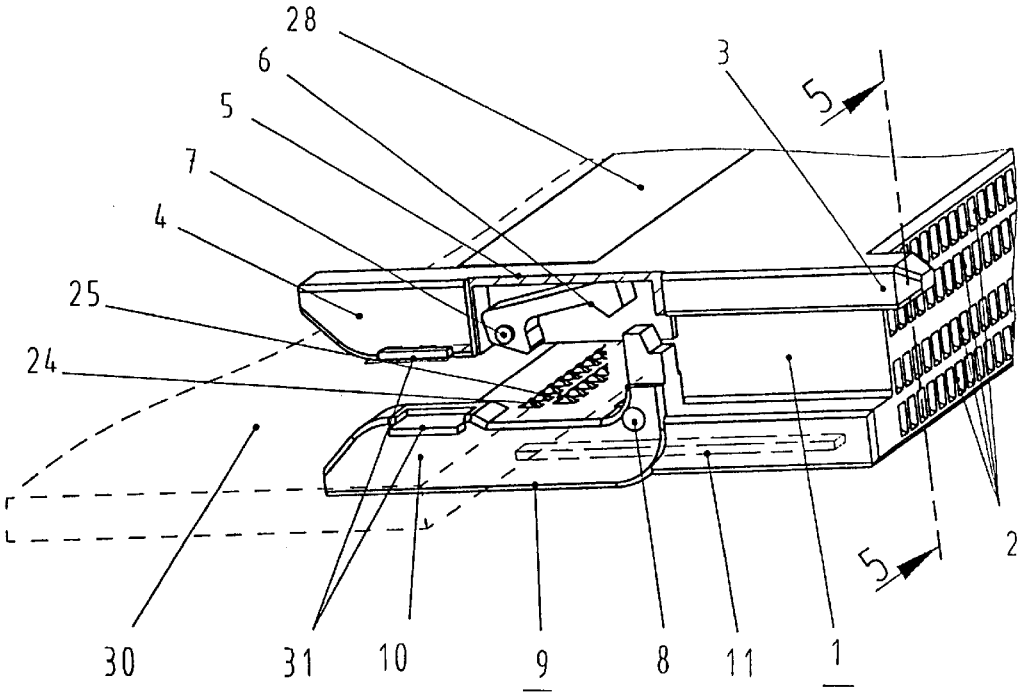
FIG. 3 shows the view of the plug connector with the press-on body unlatched.
Figure 4:
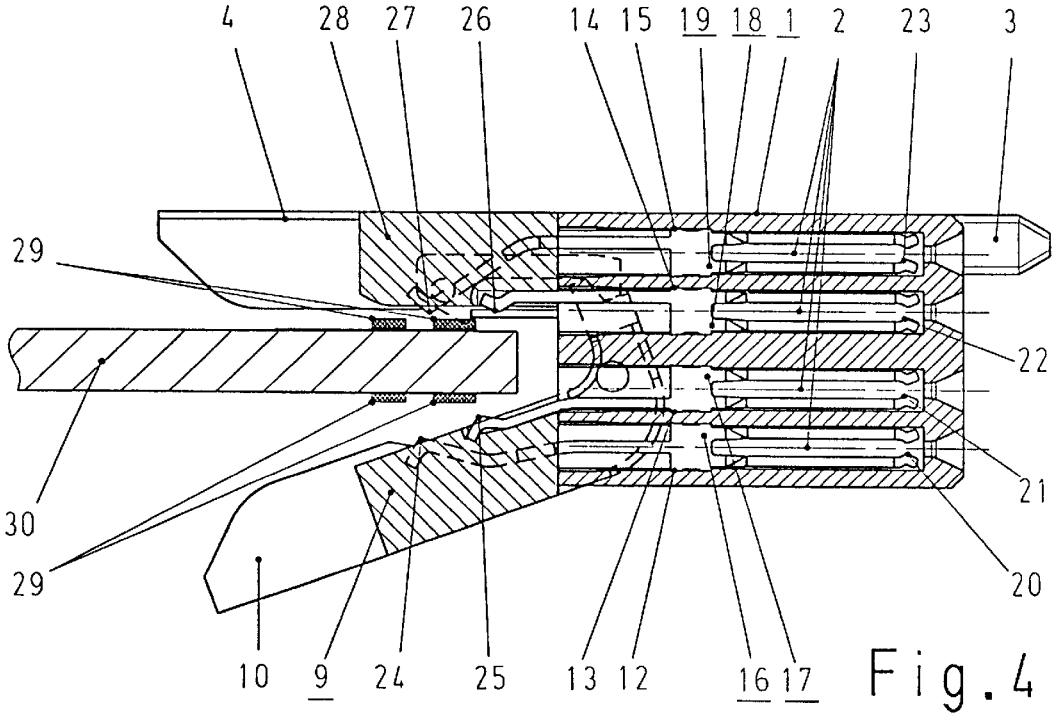
FIG. 4 shows a view of the plug connector according to FIG. 2, in section along the line 4—4.

FIGS. 1 to 5 represent the insulating body 1 of a plug connector, which body consists of plastic and has a multiplicity of contact chambers 2 let into it in two or more rows. In this instance, the plug connector is constructed as a so-called "SMD plug connector" for surface mounting on or against a printed circuit board. Attached laterally to the end face of the insulating body 1 are two guide elements 3 which ensure pre-centering of the plug connector when the latter is plugged together with a matching plug, for example a terminal strip (of which no further details are represented here). Located laterally on the rear side of the insulating body 1, that is to say the printed circuit board connection side, are two flanges 4. The flanges 4 are provided with chambers 5 which are open on at least one side. In the said chambers 5, there is provided a releasing mechanism 6 which, as represented in the figures, is rotatably mounted in a bearing 7 on the insulating body 1. Also located laterally on the insulating body 1 are two bearings 8. Rotatably mounted on the insulating body 1 in the bearing 8 is a press-on body 9 which likewise consists of insulating plastic. Two flanges 10 are likewise attached to the press-on body 9 on the rear side. By means of the releasing mechanism 6, the press-on body 9 is hinged open and opened in a "jaws-like" manner for the insertion of a printed circuit board, as represented in FIGS. 1, 2 and 4. In the process, the releasing mechanism 6 latches in this open position. The press-on body 9 is pre-tensioned by springs 11 which are located in the flanges 4 and 10.

The contacts 16, 17, 18, 19, which are preferably designed as double-legged, twisted contact springs, are held in the insulating body 1 in the region of the fixed seats 12, 13, 14, 15. The contacts 16, 17, 18, 19 consist of the following regions: the contact tulip 20, 21, 22, 23, the fixed seat 12, 13, 14, 15, and the soldering connections 24, 25, 26, 27.

Mounted on the rear side of the insulating body 1 is an insulating guide body 28 consisting of plastic. The soldering connections 26 and 27 of the contacts 18 and 19 are guided in the guide body 28, and the soldering connections 24 and 25 of the contacts 16 and 17 in the press-on body 9. Because of the guide body 28 and also of the press-on body 9, very high coplanarity of the contacts 16, 17, 18, 19 in the region of the soldering connections 24, 25, 26, 27 is achieved and, at the same time, a defined depth of impression into the solder paste 29 on the printed circuit board 30. Four metallically solderable fastening flanges 31, which are soldered to the printed circuit board 30 after the mounting of the plug connector, are fastened in the flanges 4 on the insulating body 1 and in the flange 10 on the press-on body 9. The fastening flanges 31 absorb the tensile forces and insertion forces produced when the plug connectors are plugged in and pulled out.

FIGS. 2 and 4 show, in side view and also in section, the mounting state of the plug connector, with the press-on body 9 hinged open and latched What is represented is a plug connector in which the press-on body 9 is mounted at one end, for rotation with the insulating body 1, in the bearing 8. The plug connector is pushed laterally onto a printed circuit board 30 and positioned in the correct location.

During the placing of the plug connector on the upper side of the printed circuit board 30, the releasing mechanism 6 is released and unlocks the hinged-open press-on body 9, which is pre-tensioned by the spring 11. Because of the position of the bearing 7 in conjunction with a pivotable point on the releasing mechanism 6, which point acts, when the press-on body is hinged on, on the upper side of the printed circuit board and exerts an axial force component, the plug connector is drawn against the end face of the printed circuit board 30. At the same time, the plug connector is fixed on the printed circuit board 30 by the spring force of the soldering connections 24, 25, 26, 27 of the contacts 16, 17, 18, 19 or by additional springs 1 1, until soldering takes place.

Figure 5:
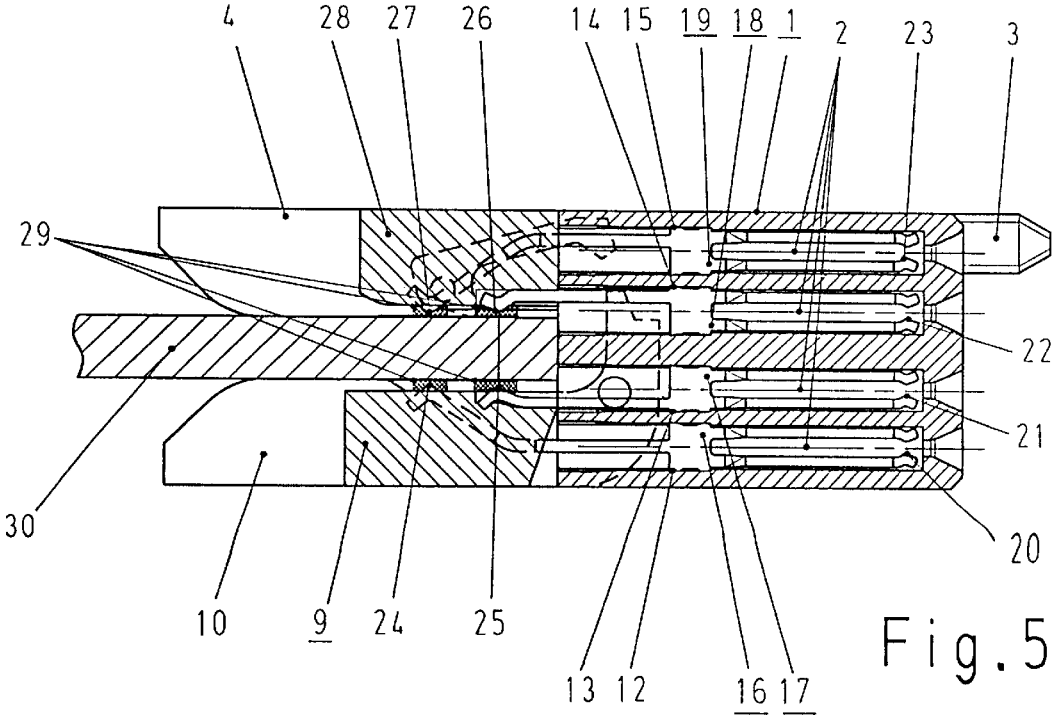
FIG. 5 shows a view of the plug-connector according to FIG. 3, in section along the line 5—5.

FIGS. 3 and 5 show, in side view and in section, the final state of the plug connector with the releasing mechanism 6 unlocked and the press-on body 9 hinged on.

During the production process, the fitting of the printed circuit board with the SMD components takes place by sides, that is to say only one side of the printed circuit board is provided with solder paste, then fitted with surface-mountable components and soldered. In the case of a printed circuit board which is fitted with components on both sides, the said board is then turned over and the second side is provided with solder paste, fitted with components and soldered. In the process, the connection contacts of the surface-mounted components must be pressed into the solder paste perpendicularly and with a defined depth. Another condition in the surface-mounting technique, which condition is determined by the automatic fitting machines themselves, is force-free or low-force mounting of the components. In order to meet both conditions in the case of a plug connector with 2 or more rows which, moreover, is not to build up to too great an extent, it is necessary to assist the low mounting force of the automatic machine by means of an additional spring force which, after the release of the releasing mechanism 6, presses the movable press-on body 9 against the printed circuit board 30. Under these circumstances, the necessary spring force can be generated by the contacts 16, 17, 18, 19 or by additional springs 11.

In order to bring this about, the soldering connections 24, 25, 26, 27 of the contacts 16, 17, 18, 19 of the plug connector are guided in a guide body 28 or in the press-on body 9. This is necessary in order to guarantee very high coplanarity. At the same time, the soldering connections 24, 25, 26, 27 of the plug connector are pressed, with a defined depth, into the solder paste 29 on the printed circuit board 30, and the plug connector is simultaneously fixed on the said printed circuit board 30.

For the process of soldering the plug connector, it is necessary for solder to be provided, as a fixed deposit of solder, on at least one of the two soldering connections 24, 25 or 26, 27 of the contacts of the plug connector. An important point in this connection is that, in the case of boards fitted with components on both sides, the second side of the printed circuit board can be provided with solder paste only after the first side has been completely fitted with surface-mounted components and soldered.

We claim:

1. A plug connector for card-edge mounting, in particular a plug connector with 2 or more rows for SMD connection to a printed circuit board, said plug connector having a printed circuit board connection side wherein said printed circuit board connection side of said plug connector has at least one press-on body (9) which is connected to an insulating body (1) of said plug connector, said plug connector having contacts (16, 17, 18, 19) and said contacts having soldering connections, said press-on body (9) being mounted so as to be capable of rotating or hinging and in which said soldering connections (24, 25, 26, 27) of said contacts (16, 17, 18, 19) of said plug connector are held, characterized in that said connector is opened in a "jaws-like" manner for the mounting process while a releasing mechanism (6) opens said press-on body (9), against the spring force of said contact springs, for the insertion of said printed circuit board, that at least one side of said soldering connections (24, 25, 26, 27) of said contacts (16, 17, 18, 19) is pressed against said printed circuit board (30) by means of said press-on body (9) on said rotatably mounted side, and that the pressing-on force of said press-on body (9) is applied by said spring force of said contact springs.

2. The plug connector according to claim 1, characterized in that soldering connections and contacts are provided on opposite sides of said printed circuit board.

3. The plug connector according to claim 1 characterized in that said plug connector is of symmetrical design.

4. The plug connector according to claim 1, characterized in that additional springs (11) bias said body (9) toward said printed circuit board (30).

5. The plug connector according to claim 1, characterized in that said additional springs (11) for achieving the necessary spring force for pressing the press-on body (9) against the printed circuit board (30) are constructed as rectangular, triangular or parabolic springs or a combination of these types of springs, or by spring wire.

6. The plug connector according to claim 1, characterized in that said soldering connections (24, 25, 26, 27) of said contacts (16, 17, 18, 19) are guided in a guide body (28) or in the press-on body (9).

7. The plug connector according to claim 1, characterized in that said soldering connections (24, 25, 26, 27) of said contacts (16, 17, 18, 19) are disposed on said printed circuit board (30) in a staggered manner.

8. The plug connector according to claim 1, characterized in that fastening flanges (31) are inserted in said flange (4) of said insulating body (1) and in said flange (10) of said press-on body (9).

9. The plug connector according to claim 1, characterized in that solder is provided, as a fixed deposit of solder, on at least one of said two soldering connections (24, 25 or 26, 27) of said contacts (16, 17 or 18, 19) of said plug connector.

* * * * *